US005116348A

United States Patent [19]

Gorter

[11] Patent Number: 5,116,348

[45] Date of Patent: May 26, 1992

[54] DEPILATING APPARATUS

[75] Inventor: Willem K. Gorter, Eindhoven, Netherlands

[73] Assignee: U.S. Philips Corp., New York, N.Y.

[21] Appl. No.: 550,587

[22] Filed: Jul. 10, 1990

[30] Foreign Application Priority Data

Jul. 10, 1989 [NL] Netherlands ..... 8901753

[51] Int. Cl.[5] ..... A45D 26/00

[52] U.S. Cl. ..... 606/133; 606/131

[58] Field of Search ..... 606/36, 39, 43, 131, 606/133

[56] References Cited

U.S. PATENT DOCUMENTS

| | | | |
|---|---|---|---|
| 2,413,576 | 12/1946 | Orner | 606/133 |
| 2,714,788 | 8/1955 | Giovanna | 606/133 |
| 2,900,661 | 8/1959 | Schnell | 606/133 |
| 4,279,253 | 7/1981 | Haes et al. | 606/133 |
| 4,726,375 | 2/1988 | Gross et al. | 606/133 |
| 4,917,678 | 4/1990 | Locke et al. | 606/133 |
| 4,923,463 | 5/1990 | Nussbaum | 606/133 |
| 4,960,422 | 10/1990 | DeMeester | 606/133 |
| 5,032,126 | 7/1991 | Cleyet et al. | 606/133 |
| 5,041,122 | 8/1991 | Schneider et al. | 606/133 |
| 5,041,123 | 8/1991 | Oliveau et al. | 606/133 |
| 5,071,423 | 12/1991 | Piber et al, | 606/133 |

FOREIGN PATENT DOCUMENTS

| | | | |
|---|---|---|---|
| 0147285 | 7/1985 | European Pat. Off. | 606/133 |
| 417935A1 | 8/1990 | European Pat. Off. . | |
| 57-54725 | 11/1982 | Japan . | |

*Primary Examiner*—Stephen C. Pellegrino
*Assistant Examiner*—Glenn K. Dawson
*Attorney, Agent, or Firm*—Ernestine C. Bartlett

[57] ABSTRACT

A depilating apparatus is provided comprising a depilating member which can be driven so as to be rotating and at least one clamping element. The depilating member is disc-shaped and comprises entrance slots which open into an end face, a clamping element being situated in an entrance slot so as to be movable with respect to the depilating member.

24 Claims, 5 Drawing Sheets

DEPILATING APPARATUS

FIELD OF THE INVENTION

The invention relates to a depilating apparatus comprising a depilating member which can be driven so as to be rotating and at least one clamping element.

BACKGROUND OF THE INVENTION

Such a depilating apparatus is known, for example, from Japanese utility model 57-54725. The depilating member and the clamping member in this model are constructed as rollers which are rotatable about parallel axes. The contact surface between the two rollers is only small so that a tensile force is exerted only for a short period of time on a hair which is clamped between the rollers. A cover plate is present to prevent the skin from getting in the comparatively large wedge-shaped entrance space between the rollers and from being also clamped between the rollers. Short hairs having a length in the order of the thickness of the cover plate cannot be clamped by the rollers as a result of the cover plate.

SUMMARY OF THE INVENTION

An object of the invention is to provide a depilating apparatus in which the above-mentioned disadvantages are avoided and the invention is characterized in that the depilating member is disc-shaped and comprises entrance slots which open into an end face, a clamping element which is movable with respect to the depilating member being present in an entrance slot.

In special embodiments of the invention, the entrance slots open into a cylindrical open jacket of the depilating member; and/or the clamping element can be moved with respect to the depilating member in a substantially tangential direction; and/or the clamping element can be moved with respect to the depilating member in a substantially radial direction; and/or the clamping element can be moved with respect to the depilating member in a substantially axial direction; and/or the entrance slot is wedge-shaped and the clamping element has a corresponding shape and is movable between a position in which the clamping element engages the depilating member and a position in which an entrance slot is present between the clamping element and the depilating member; and/or the clamping element comprises a lever a first end of which is connected to the clamping element and the second end of which is in contact with a guide wall in the housing during at least a part of a revolution of the depilating member; and/or the clamping elements are united to form a clamping member which forms a unit which together with the depilating member can be driven so as to be rotating; and/or the clamping member is journalled eccentrically with respect to the depilating member; and/or the depilating member and the clamping member are movable with respect to each other in an axial direction; and/or the resilient means are present between the depilating member and the clamping member; and/or the depilating member, the clamping element and the housing are constructed as a depilating unit which can be exchanged with a detachable shaving head of a shaving apparatus.

BRIEF DESCRIPTION OF THE DRAWINGS

The invention will now be described in greater detail with reference to a description of a few embodiments shown in the drawing, in which.

DESCRIPTION OF PREFERRED EMBODIMENTS

Figure 1:
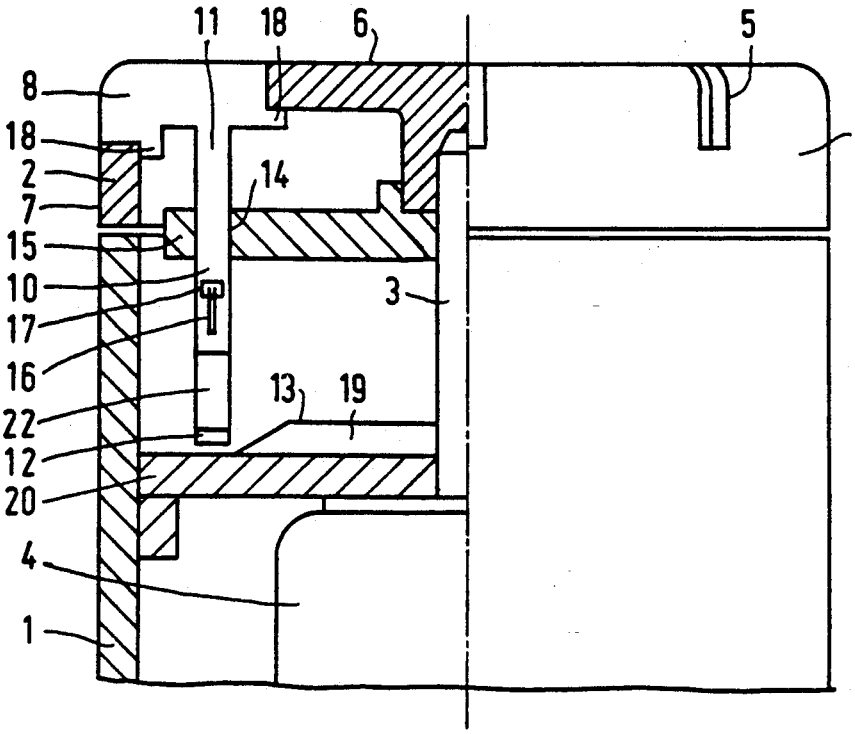
FIG. 1 is a partial cross-section and a partial elevation of a depilating apparatus.
Figure 2:
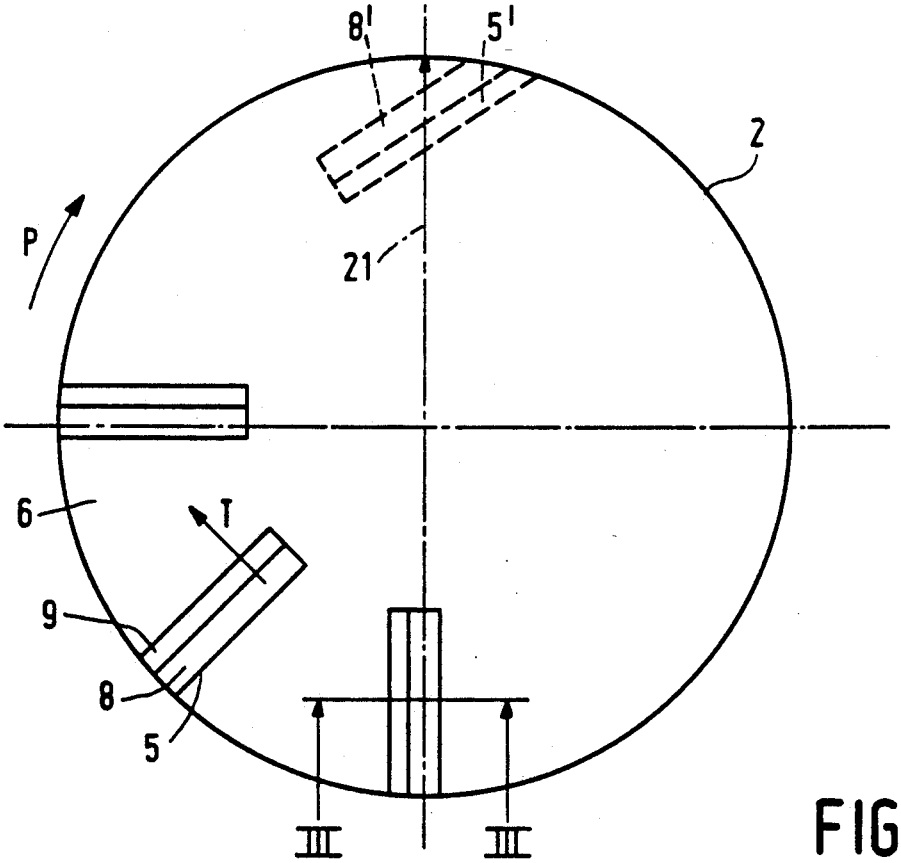
FIG. 2 is a plan view of the depilating apparatus shown in FIG. 1.
Figure 3:
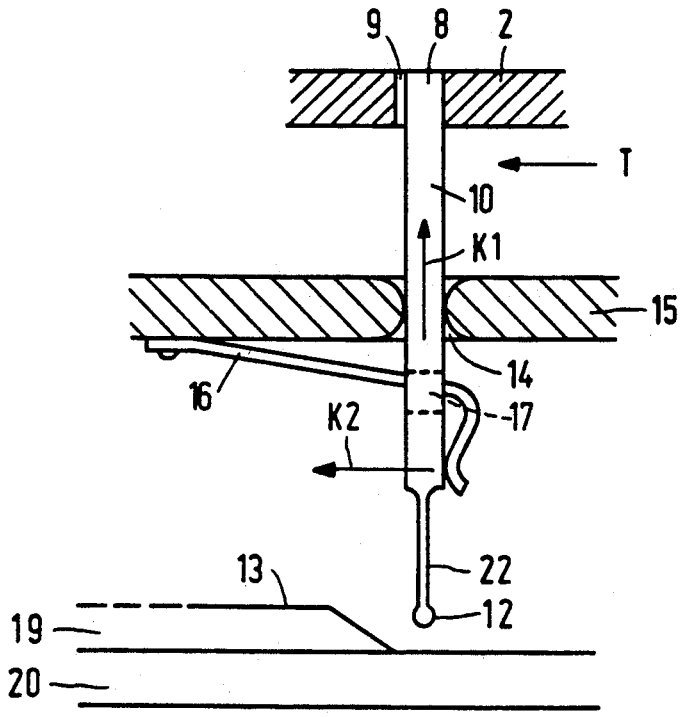
FIG. 3 is a cross-sectional view taken on the line III—III in FIG. 2.
Figure 4:
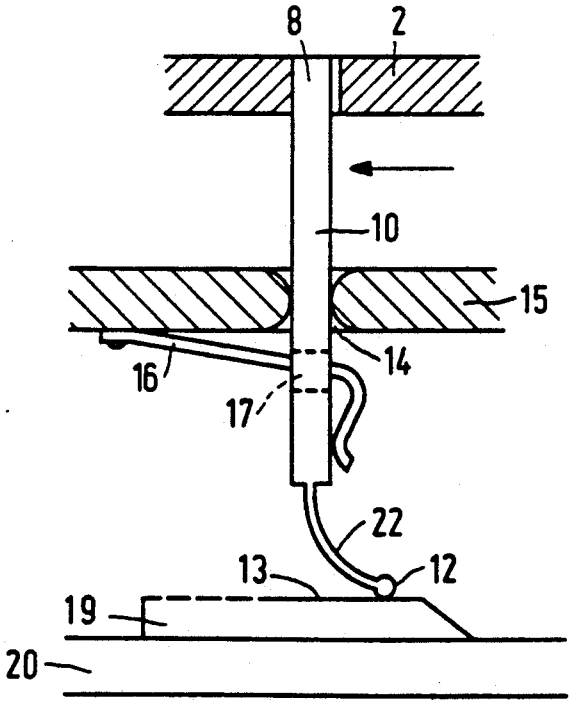
FIG. 4 is a cross-sectional view corresponding to FIG. 3 with another position of the clamping element.

The depilating apparatus shown in FIGS. 1 to 4 comprises a housing 1 and a disc-shaped depilating member 2. The depilating member 2 is connected to the end of the shaft 3 of the electric motor 4 so that the depilating member can be driven rotatably, for example, in the direction P. The disc-shaped depilating member 2 comprises entrance slots 5 which are regularly distributed over the circumference and of which only a few are shown in FIG. 2 to avoid complexity of the drawing. The entrance slots 5 open both into the end face 6 and in the cylindrical outer jacket 7 of the depilating member 2 and each entrance slot comprises a clamping element 8. The clamping element 8 has a smaller thickness than the entrance slot 5 so that an entrance slot 9 for trapping hairs remains. The clamping element 8 is not shown in cross-section for clarity in FIG. 1.

The clamping element can be moved in a substantially tangential direction T with respect to the depilating member 2. For this purpose the clamping element 8 comprises a lever 10 a first end 11 of which is connected to the clamping element while a second end 12 is situated within reach of a guide wall 13 in the housing 1. The lever 10 is journalled so as to be rotatable in an aperture 14 of a holder 15 which forms part of the depilating member 2. A resilient element 16 is also connected to the holder 15 and is hooked through an aperture 17 in the lever 10 and exerts pressure forces $K_1$ and $K_2$ on the assembly of clamping element 8 and lever 10. The clamping element 8 is positioned with respect to the depilating member 2 by means of cams 18.

During a part of a revolution of the depilating member 2 the end 12 of a lever 10 is in contact with the guide wall 13. The assembly of lever 10 and clamping element 8 is tilted as a result from the position shown in FIG. 3 into the position shown in FIG. 4. A hair which is present in the entrance slot 9 is thus clamped between the depilating member 2 and the clamping element 8.

During use the apparatus is placed with the end face 6 on the skin to be depilated and is moved over the skin. When a hair is clamped in the above-described manner, the hair will be pulled out of the skin as a result of the rotation of the depilating member and the clamping element. After a part of a revolution the end 12 of the lever 10 will be released from the guide wall 13 as a result of which the clamping member 8 is again placed in the FIG. 3 position as a result of the action of the resilient element 16. The guide wall 13 may form part, for example, of an abutment 19 on the assembly plate 20 for the motor 4.

Because the entrance slots 9 open into the cylindrical outer jacket 7 the hairs may also enter an entrance slot 9 from the circumference of the depilating member 2. The chance of trapping a hair can even be improved by placing the entrance slots 5 and the clamping element 8 at an angle with respect to the radius 21 as is shown in broken lines in FIG. 2 by 5' and 8', respectively. The trap chance will moreover depend on the number of entrance slots 5 per depilating member 2.

Several abutments 19 with guide walls 13 may be provided in the housing so that a clamping element 8 is tilted by the associated lever several times per revolution. At least a part 22 of the lever 10 is constructed so as to be elastically deformable as a result of which the contact with the guide wall 13 occurs more flexibly and less high requirements need be imposed upon the size accuracy of the levers. Moreover, as a result of this, it is possible to prevent cutting of the hair as a result of too large a clamping force between the depilating member 2 and the clamping element 8.

The clamping element 8 and the lever 10 are preferably manufactured from a synthetic resin as one assembly.

Figure 5:
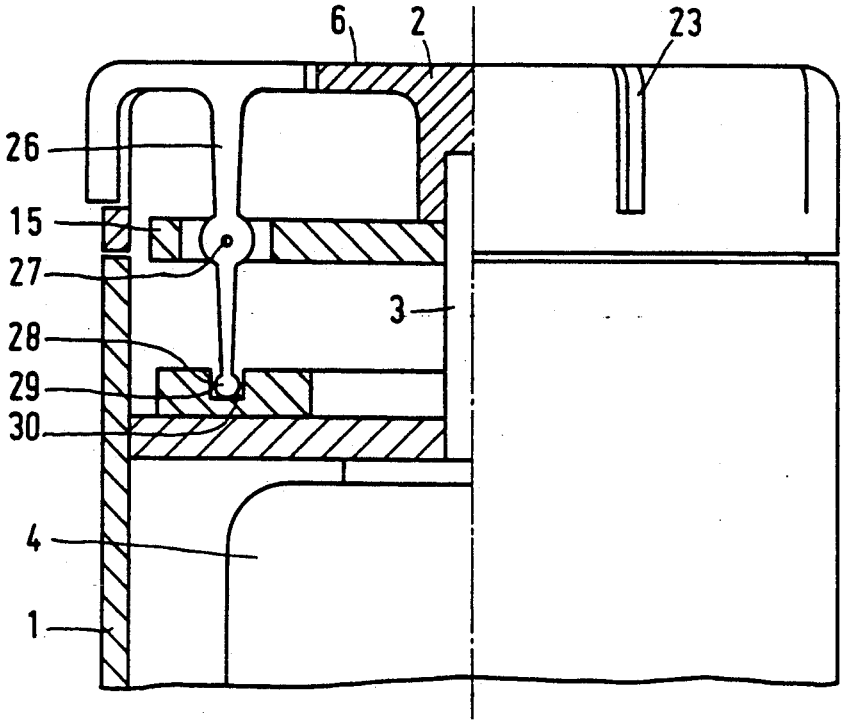
FIG. 5 is a partial cross-sectional view and a partial elevation of another embodiment of a depilating apparatus.
Figure 6:
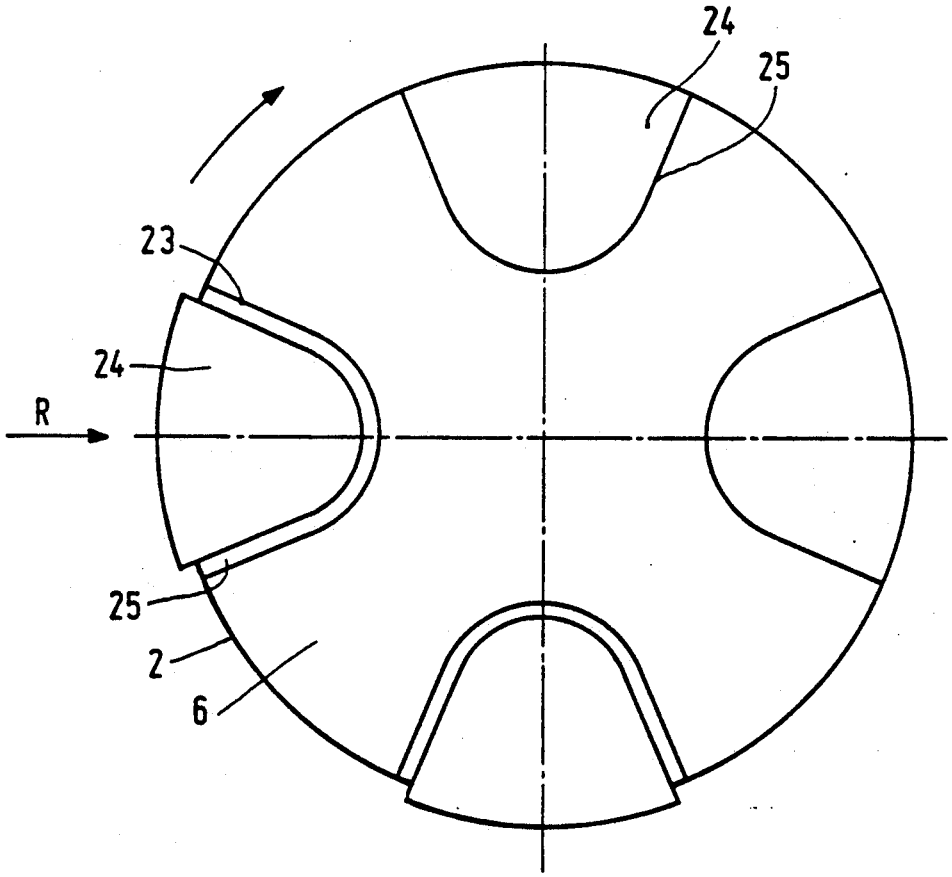
FIG. 6 is a plan view of the apparatus shown in FIG. 5.

The embodiment shown in FIGS. 5 and 6 also comprises a housing 1, a depilating member 2 having an end face 6 and a motor 4 with motor shaft 3 and in outline is equal to that of FIGS. 1 to 4.

However, viewed in the plan view of FIG. 6, the entrance slots 23 are wedge-shaped and the clamping elements 24 have a corresponding shape. The clamping elements 24 can be moved in the radial direction R with respect to the depilating member 2 between a position in which an entrance slot 25 is present between the clamping element and the depilating member and a position in which the clamping element engages the depilating member. For this purpose the clamping element 24 again comprises a lever 26 which is journalled so as to be rotatable about a shaft 27 in the holder 5 directed transversely to the radial direction R. One end 28 of the lever 26 is in contact with a guide wall 29 formed by the wall of a circumferential groove 30. As a result of the varying distance of the groove 30 to the motor shaft 3 the clamping element 24 during one revolution of the depilating member will be moved at least once in the direction R. As a result of this, a hair which is present in the entrance slot 25 can be clamped again and pulled out.

Figure 7:
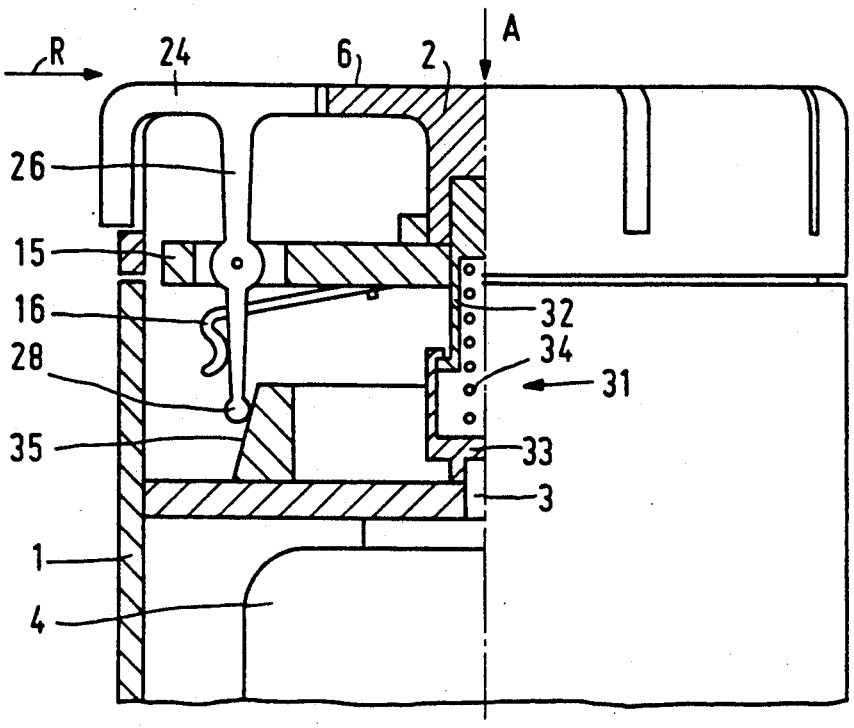
FIG. 7 is a partial elevation and a partial cross-sectional view of a modified embodiment of FIGS. 5 and 6.

FIG. 7 is a modification of the embodiment of FIGS. 5 and 6. A coupling shaft 31 having two parts which are telescopically movable with respect to each other and between which a pressure spring 34 is present is situated between the motor shaft 3 and the depilating member 2. The assembly of depilating member 2 with clamping elements 24, levers 26 and holder 15 can be depressed axially as a result of this with respect to the housing 1. The housing 1 comprises a conical wall 35 against which the end 28 of the lever 26 engages. A resilient element 16 as described in the FIGS. 3 and 4 embodiment ensures a pressure force at the end 28 in the direction of the conical wall 35. When using the apparatus the depilating member will be moved in the axial direction A with respect to the housing by exerting pressure with the end face 6 on the skin to be depilated, as a result of which the end 28 will slide along the conical wall and the clamping element 24 is moved in the direction R.

Figure 8:
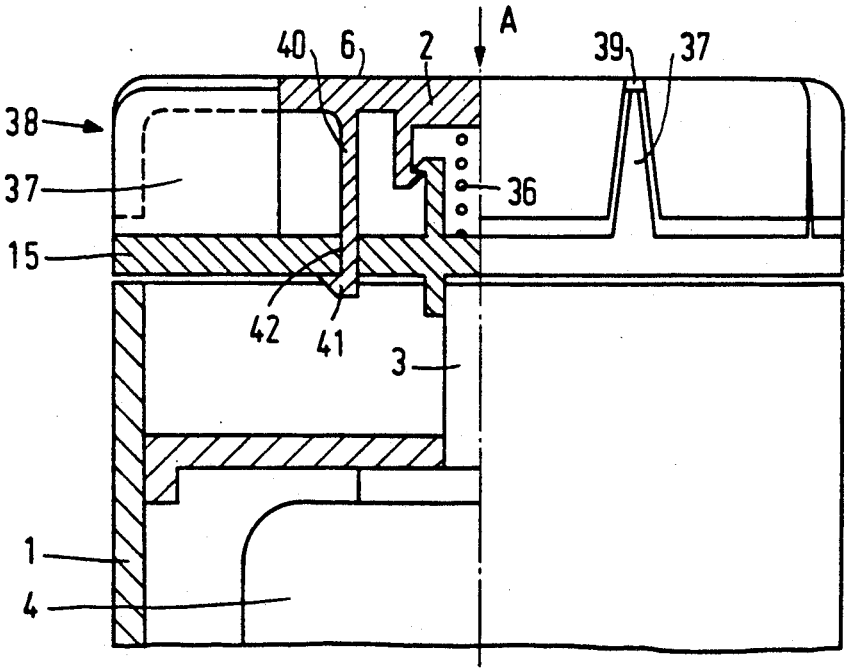
FIG. 8 is a partial elevation and a partial cross-sectional view of still another embodiment.
Figure 9:
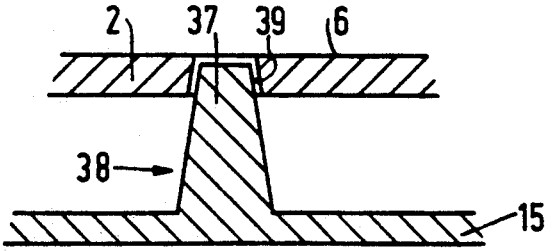
FIG. 9 is a cross-sectional view corresponding to FIG. 3 of the FIG. 8 embodiment.

In the embodiment shown in FIGS. 8 and 9 the depilating member 2 can be moved telescopically in the axial direction A with respect to the holder 15, a pressure spring 36 being tensioned between the two parts. The clamping elements 37 are rigidly connected to the holder 15 and together with the holder constitute a clamping member 38. The clamping elements 37 are slightly tapered in the axial direction in accordance with the entrance slots 39.

Three resilient arms 40 of which only one is shown comprises hook-like ends 41 and project through apertures 42 in the holder 15 so that they prevent the depilating member 2 from being pressed away by the compression spring 36 of the holder 15. In this case also the depilating member can be moved in the axial direction A against the action of the spring 36 with respect to the holder 15 with clamping elements 37 by pressure of the skin on the end face 6, as a result of which the clamping elements engage the depilating member.

In the two embodiments shown in FIGS. 7 to 9 the user can determine the frequency at which depilation is carried out by exerting alternating pressure with the apparatus.

Figure 10:
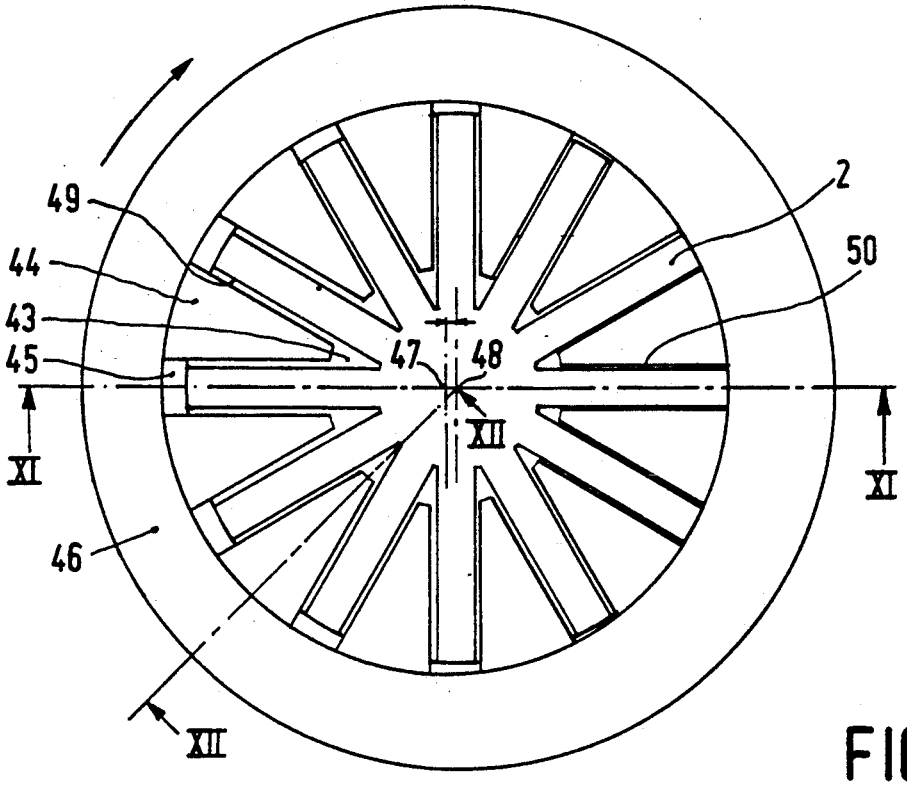
FIG. 10 is a plan view of still another embodiment.
Figure 11:
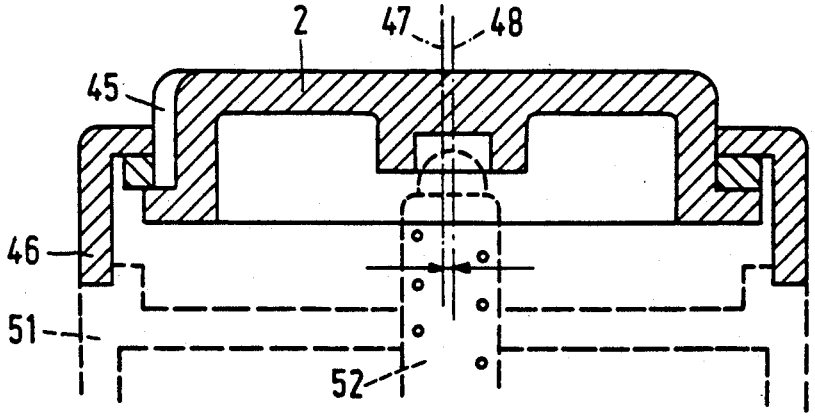
FIG. 11 is a cross-sectional view taken on the line XI—XI in FIG. 10.
Figure 12:
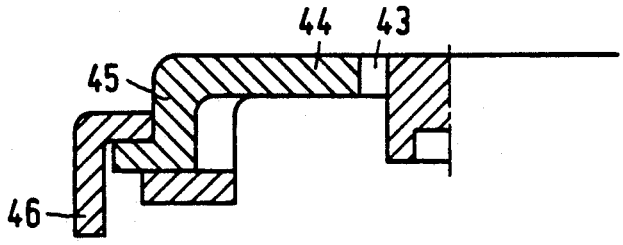
FIG. 12 is a cross-sectional view taken on the line XII—XII in FIG. 10.

FIGS. 10, 11 and 12 show an embodiment in which the hair entrance slots 43 and the clamping elements 44 are also wedge-shaped. The clamping elements 44 are combined to form a clamping member 45 which is journalled so as to be rotatable in the housing part 46 with an axis of rotation 47 which is eccentric with respect to the axis of rotation 48 of the depilating member 2. As a result of the rotating driving of the depilating member 2 the clamping member 45 is also driven so as to be rotating. As a result of the eccentricity of the axis of rotation 47 with respect to the axis of rotation 48 the clamping elements 44 during a part of a revolution will be moved inwardly relatively with respect to depilating member 2 in the corresponding entrance slots 43 as is shown in the right-hand half of FIG. 10, as a result of which a hair which is present in an entrance slot 49 is again clamped and pulled out.

Rotation of depilating member 2 and clamping member 45 is possible only if some play 50 between a clamping element 44 and the depilating member 2 is also present in the situation as is shown in the right-hand side of FIG. 10. As a result of the small eccentricity of the axis of rotation 47 with respect to the axis 48, said play may be so small that nevertheless a hair is clamped between a clamping element 44 and the depilating member 2.

In an embodiment as shown in FIGS. 10, 11 and 12, depilating member 2, clamping member 45 and housing part 46 are combined to form a depilating unit which can be exchanged with a detachable shaving unit of a shaving apparatus. Such a shaving apparatus 51 of the known type having rotating shaving members is shown in FIG. 11 in broken lines. The depilating member 2 may then be coupled, for example, directly to the shaft 52 for the rotating shaving member.

Such a construction as an exchangeable depilating unit can also simply be realized in the other embodiments.

Since the width of the entrance slots in the above-described embodiments may be small, the end faces of the depilating members may be brought in contact with the skin directly without the possibility existing of the skin being clamped by the apparatus. A grid or skin retaining member will hence not be necessary, although such a provision may be made in the embodiments described.

In addition to an embodiment having one depilating member per apparatus, the depilating apparatuses may also be equipped with two or more depilating members.

I claim:

1. A depilating apparatus for removing hair from the skin comprising a housing containing a depilating member which can be driven so as to be rotating; means for driving said depilating member; and at least one clamping element, wherein the depilating member is disc-shaped and comprises entrance slots which open into an end face of said depilating member which is adpted to contact the surface of the skin, at least one said clamping element which is movable with respect to the depilating member being present in an entrance slot.

2. A depilating apparatus as claimed in claim 1, wherein the entrance slots also open into a cylindrical outer jacket of the depilating member.

3. A depilating apparatus as claimed in claim 2 wherein the clamping element can be moved with respect to the depilating member in a substantially tangential direction relative to the entrance slots of the depilating member.

4. A depilating apparatus as claimed in claim 2 wherein the clamping element can be moved with respect to the depilating member in a substantially radial direction.

5. A depilating apparatus as claimed in claim 2 wherein the clamping element can be moved with respect to the depilating member in a substantially axial direction.

6. A depilating apparatus as claimed in claim 1 wherein the clamping element can be moved with respect to the depilating member in a substantially tangential direction relative to the entrance slots of the depilating member.

7. A depilating member as claimed in claim 1, wherein the clamping element can be moved with respect to the depilating member in a substantially radial direction.

8. A depilating apparatus as claimed in claim 1, wherein the clamping element can be moved with respect to the depilating member in a substantially axial direction.

9. A depilating apparatus as claimed in claim 1 wherein the entrance slot is wedge-shaped and the clamping element has a corresponding shape and is movable between a position in which the clamping element engages the depilating member and a position in which an entrance slot is present between the clamping element and the depilating member.

10. A depilating apparatus as claimed in claim 1 wherein the clamping element comprises a lever a first end of which is connected to the clamping element and the second end of which is in contact with a guide wall during at least a part of a revolution of the depilating member.

11. A depilating apparatus as claimed in claim 9 wherein the depilating member, the clamping element and the housing are constructed as a depilating unit which can be exchanged with a detachable shaving head of a shaving apparatus.

12. A depilating apparatus as claimed in claim 1 wherein the clamping element comprises a lever a first end of which is connected to the clamping element and the second end of which is in contact with a guide wall in the housing during at least a part of a revolution of the depilating member.

13. A depilating apparatus as claimed in claim 1 comprising a plurality of clamping elements, said clamping elements are united to form a clamping member which forms a unit which together with the depilating member can be driven so as to be rotating.

14. A depilating apparatus as claimed in claim 13 wherein the clamping member is journalled eccentrically with respect to the depilating member.

15. A depilating apparatus as claimed in claim 14 wherein the depilating member, the clamping element and the housing are constructed as a depilating unit which can be exchanged with a detachable shaving head of a shaving apparatus.

16. A depilating apparatus as claimed in claim 13 wherein the depilating member and the clamping member are movable with respect to each other in the axial direction.

17. A depilating apparatus as claimed in claim 16 wherein resilient means are present between the depilating member and the clamping member.

18. A depilating apparatus as claimed in claim 11 wherein the depilating member, the clamping element and the housing are constructed as a depilating unit which can be exchanged with a detachable shaving head of a shaving apparatus.

19. A depilating apparatus as claimed in claim 16 wherein the depilating member, the clamping element and the housing are constructed as a depilating unit which can be exchanged with a detachable shaving head of a shaving apparatus.

20. A depilating apparatus as claimed in claim 13 wherein the depilating member, the clamping element and the housing are constructed as a depilating unit which can be exchanged with a detachable shaving head of a shaving apparatus.

21. A depilating apparatus as claimed in claim 1 wherein the depilating member, the clamping element and the housing are constructed as a depilating unit which can be exchanged with a detachable shaving head of a shaving apparatus.

22. A depilating apparatus comprising a depilating member which can be driven so as to be rotating and provided with at least one clamping element, means to drive said depilating member, the depilating member being disc-shaped and comprising entrance slots for the hairs to be removed, the clamping element being movable between a first position in which the clamping element engages the depilating member and a second position in which an entrance slot is present between the clamping element and the depilating member, wherein a hair present in said entrance slot when said clamping element is in said first position is clamped and removed from the skin during revolution of the depilating member.

23. A depilation apparatus as claimed in claim 22 wherein the clamping element comprises a lever a first end of which is connected to the clamping element and the second end of which is in contact with a guide wall in the housing during at least a part of a revolution of the depilating member.

24. A depilating apparatus as claimed in claim 22 wherein the depilating member, the clamping element and the housing are constructed as a depilating unit which can be exchanged with a detachable shaving head of a shaving apparatus.

* * * * *